United States Patent [19]

Ridgewell et al.

[11] Patent Number: 4,500,120

[45] Date of Patent: Feb. 19, 1985

[54] CATCH OR LOCK

[75] Inventors: Terence E. Ridgewell, Gravesend; Keith Vallis, Windsor, both of England

[73] Assignee: Kimberly-Clark Limited, Kent, England

[21] Appl. No.: 452,142

[22] Filed: Dec. 22, 1982

[51] Int. Cl.[3] ..... E05C 19/08

[52] U.S. Cl. ..... 292/19; 292/27; 292/83

[58] Field of Search ..... 292/19, 20, 83, 85, 292/27, 124; 70/123, 67–76, 95–97

[56] References Cited

U.S. PATENT DOCUMENTS

| | | | |
|---|---|---|---|
| 345,337 | 7/1886 | Tollner | 292/19 X |
| 354,597 | 12/1886 | Crouch | 292/20 |
| 857,322 | 6/1907 | Baker | 292/27 X |
| 1,147,530 | 7/1915 | Mentz | 292/19 |
| 1,439,229 | 12/1922 | Cohon et al. | 292/27 |
| 2,507,511 | 5/1950 | Freidag et al. | 292/19 |
| 2,976,714 | 3/1961 | Wofgesang | 70/71 X |

FOREIGN PATENT DOCUMENTS

| | | | |
|---|---|---|---|
| 6927 | 4/1927 | Australia | 70/75 |
| 142317 | 11/1902 | Fed. Rep. of Germany | 70/97 |
| 1678017 | 12/1969 | Fed. Rep. of Germany | 292/27 |
| 385542 | 3/1908 | France | 292/27 |
| 852327 | 10/1960 | United Kingdom | 292/27 |

*Primary Examiner*—Robert L. Wolfe
*Assistant Examiner*—Lloyd A. Gall
*Attorney, Agent, or Firm*—Fidelman, Wolffe & Waldron

[57] ABSTRACT

A catch or lock with a cam (3) rotatable to move one or two resilient latching arms (20) at the end of which may be latching means (25) engageable on a hasp (4) to catch or lock an article. The cam (3) or casing (1) has a follower (18) which acts in a groove (15) with a ramped bottom dividing the groove into two portions and preventing the cam from being rotated from the second back to the first portion. When the cam is in a first position (X) with the follower in the first portion the latching means are held open and are inoperative for latching. The key is then inserted to move the cam so the follower is in the second portion, the cam being movable between positions (Y) and (Z) in which the latching means open and close respectively, and the key is removable in position (Z).

8 Claims, 6 Drawing Figures

CATCH OR LOCK

The present invention relates to a catch or lock.

A catch or lock in accordance with the invention comprises a rotatable cam, means in or on the cam for accepting a key so that the cam can be rotated, at least one latch arm and a hasp, the latch or latches being biassed into engagement with the cam, the latch or latches being engageable with the hasp for locking, the arrangement being such that on insertion of the key into the catch or lock the cam may be rotated to disengage the latch or latches from the hasp, wherein a casing is provided, and wherein a groove is provided on the casing or cam with a ramped bottom so as to divide the groove into two portions, the cam or casing having a follower engaging in the groove, the ramp being such that the cam can be moved by the key from the first portion to the second portion but not in reverse, the key being able to be inserted or removed when the latch or latches are disengaged at a first position of the cam when the follower is in the first groove portion and the key being able to be received or inserted when the latch or latches are engaged at a second position of the cam when the follower is in the second groove portion, the cam being movable to a third cam position when the follower is in the second groove portion at which third position the latch or latches are disengaged.

The arrangement provides a very simple lock which is economical to mould and can be operated by a simple key which is preferably double bitted.

The advantage of the above arrangement is that the catch or lock can be in a semi-permanently disengaged condition when the cam follower is in the first portion and is inoperative. This particularly useful for a dispenser for paper towels and the like which some operators prefer to be unlocked. In this case the cover is retained by suitable non-locking means such as a stud springing into a hole. If the dispenser operator requires the cover to be lockable, the cam follower is turned by the key to the second groove portion where the lock or catch is fully operative.

Preferably the cam is substantially triangular in shape and two latches are provided, the cam acting between the latches so that on rotation of the cam both latches are disengaged from the hasp.

Figure 1:
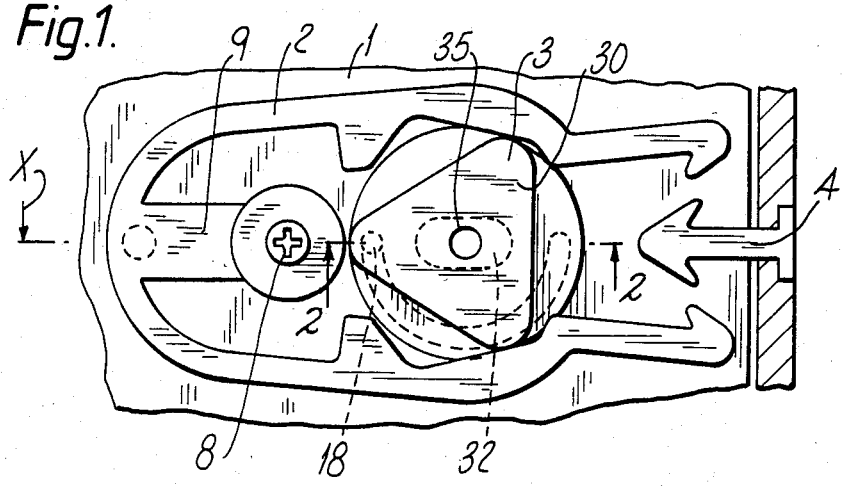
Figure 2:
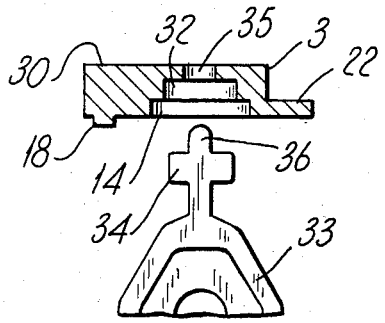
Figure 3:
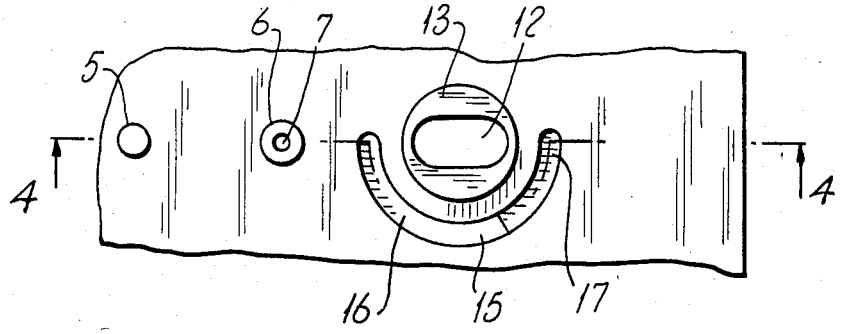
Figure 4:
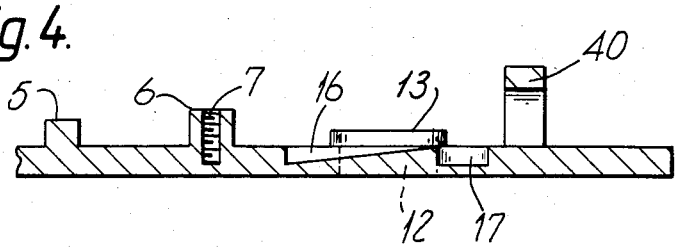
Figure 5:
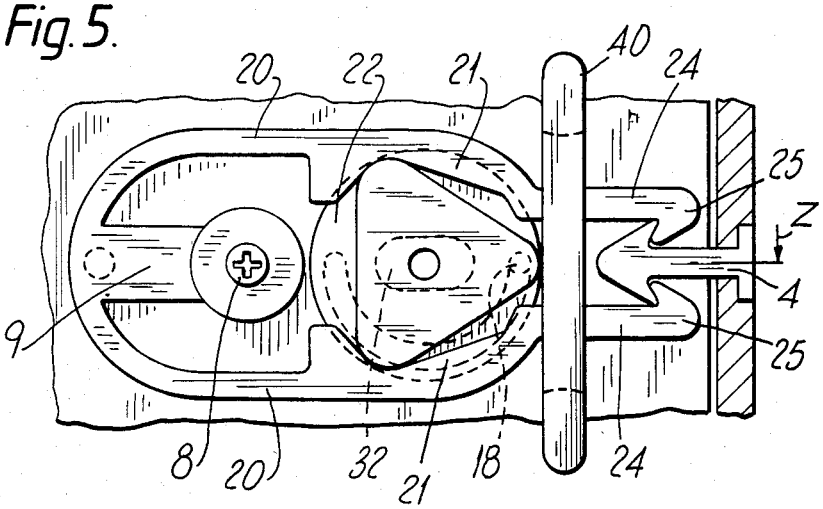
Figure 6:
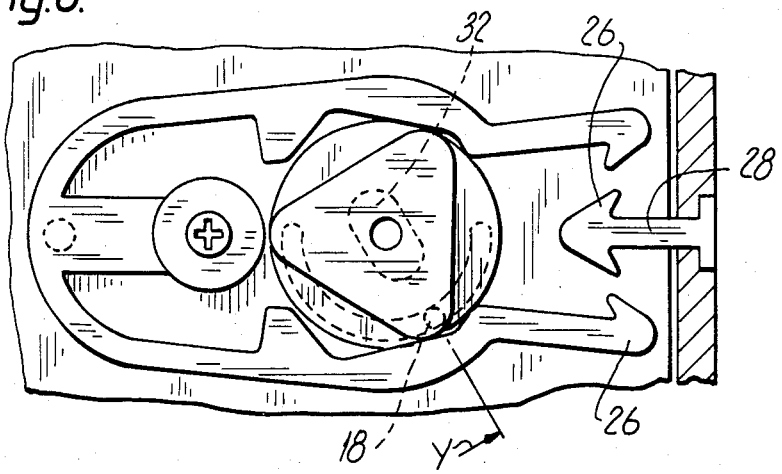

The invention will now be described by way of example with reference to the accompanying drawings in which:

FIG. 1 is a plan view of a catch or lock according to the invention with the cam in a groove first portion and unlatched, FIG. 2 is a cross section of part of FIG. 1 taken on 2—2 with a key for operating the lock, FIG. 3 is a plan view of the catch or lock of FIG. 1 showing the casing only, FIG. 4 is a cross-section of the casing of FIG. 3 taken on 4—4 showing particularly the groove, FIG. 5 is a plan view of the catch or lock of FIG. 1 with the cam in a groove second portion and latched, and, FIG. 6 is a plan view of the catch or lock of FIG. 1 with the cam in the groove second portion and unlatched.

In FIG. 1 of the drawings a catch or lock is shown formed from four main parts, namely a casing 1, a double latch member 2, a cam 3 and a hasp 4.

The casing as shown in FIGS. 3 and 4 comprises a stud 5 engageable with a hole in the latch member 2, and a protrusion 6 with a tapped hole 7 to receive a screw 8, the screw 8 and stud 5 firmly locating the latch member's rear portion 9 on the casing. The casing also has a key aperture 12 surrounded by a bearing protrusion 13 for engaging with a recess 14 in the cam 3. Also the casing has a groove 15 which has a ramped first portion 16 and a second portion 17. The groove receives a follower 18 projecting from the bottom of the cam and the follower can rotate anti-clockwise over the ramp in the groove from position X in FIG. 1 and into the second portion 17 but cannot rotate clockwise from second portion 17 to first portion 16 because of the ramp.

The double latch member 2 as shown in FIG. 5 comprises a rear portion 9 firmly located on the casing as described above, resilient portions 20 extending from the fixed rear portion 9, cam engaging portions 21 which overlie a circular flange 22 of the cam so as to hold the cam onto the casing, and latch portions 24 terminating in hooks 25 which engage with barbs 26 of the hasp.

The cam 3 is formed with a central triangular portion 30 in which is a recess 32 for a key 33 having a double bit 34. The portion 30 also has a hole 35 to receive the stem end 36 of the key. The cam also has follower 18, a retaining flange 22 and recess 14 as already described.

The hasp is formed as described with two barbs 26 extending either side of a stem 28 (see FIG. 6).

In order to ensure that when the key is inserted in the cam the latch portions 24 are not forced out of engagement with the hasp, a bridge 40 secured to the casing may be provided (see FIGS. 4 and 5).

A plug (not shown) can be fitted in casing key aperture 12 if the lock is not to be operative.

The lock is normally supplied with the plug in aperture 12 and the lock is in a first supplementary non-locking state as shown in FIG. 1 with the follower 18 in position X. If it is required to use the lock the plug is removed, the key inserted in cam 3 into aperture 32 and the cam rotated so that the follower snaps over the ramp into second groove portion 17. On reaching position Z as shown in FIG. 5 the key can be removed and the lock is latched. To unlatch the lock the key is reinserted and the cam moved to position Y as shown in FIG. 6. In this position the key cannot be removed because recess 32 is misaligned with aperture 12. When the cam is in position Z as shown in FIG. 5 the hasp 4 can be sprung in locking engagement with latch member 2.

It will be obvious from the fact that the cam 3 has an equilateral triangular shape that starting at position X (as in FIG. 1) where the key is insertable and the latch member is open, the cam is movable after key insertion through 120° to position Y (as in FIG. 6) where the latch member is again open. Thence the cam moves through a further 60° to position Z (as in FIG. 5) where the key is removable and the latch member is closed. The total cam movement is 180°, with the acrucate length of the groove being slightly greater to allow for cam follower thickness. The first portion 16 of the groove 15 is about 120° and the second portion 17 about 60°, with an allowance for cam follower thickness.

A particular use for the lock described above is in a dispenser for paper towels and the like where some operators prefer the dispenser to be permanently unlocked while some operators prefer a lockable dispenser.

It will be appreciated that the casing 1 can form part of an article to be locked, that is, casing 1 can be integral with the object being locked or casing 1 can be a plate or the like which is attached by attachment means such as screws to the object being locked.

It will also be appreciated that while the follower is described as being on the cam and the groove in the casing, the reverse is within the scope of the invention and would be equally effective. Also the groove can be circular with the second portion 120° and the first portion 240° in arcuate length.

We claim:

1. A lock comprising a casing, a rotatable cam mounted to the casing, means of the cam for accepting a key, a latch comprising at least one latch arm including a hasp engaging latching means, the latch being in co-operable relationship with the cam, a hasp with which each latching means is engageable for locking, the arrangement being such that on insertion of the key into the lock the cam may be rotated to disengage the latch from the hasp, two abutments forming stop means for determining releasing and locking positions of said cam, the key being insertable or removable when the cam is in the locking position, wherein a groove and follower cooperatively couple the casing and cam, the groove having a first and second portion, said first portion having a ramp with a raised end forming one of said abutments at an end of said second portion, another of said abutments formed at another end of said second portion, the follower engaging in the groove and acting with the abutments to limit the movement of the cam relative the casing and acting with said ramp to limit said movement in a direction from said first portion to said second portion and not in reverse of said direction, an end of said first portion remote from said second portion defining a first supplementary releasing position of the cam, the key being insertable or removable from said lock at said first supplementary releasing position.

2. A lock as claimed in claim 1 wherein the latch is formed as a member with a securing portion which is secured to the casing, said latch arms being at least partially resilient and extending from the securing portion to said latching means and being engageable with the hasp.

3. A lock as claimed in claim 2 wherein a bridge means extends over said arms to prevent undue movement in a direction parallel with an axis of rotation of the cam.

4. A lock as claimed in claim 2 wherein the cam is provided with a circular retaining portion which is engageable under said arms to retain the cam between the arms and the casing.

5. A lock as claimed in claim 1 wherein the cam is substantially triangular.

6. A lock as claimed in claim 1 wherein the groove and cam follower act so as to guide the cam in its arcuate movement.

7. A lock as claimed in claim 1 wherein said groove extends substantially over 180°, said first portion extending over substantially 120°.

8. A lock as claimed in claim 1 wherein said follower protrudes from said cam.

* * * * *